US009358174B1

(12) United States Patent
Gallo

(10) Patent No.: US 9,358,174 B1
(45) Date of Patent: Jun. 7, 2016

(54) SPINAL DECOMPRESSION APPARATUS

(71) Applicant: Natalia Gallo, Little Falls, NJ (US)

(72) Inventor: Natalia Gallo, Little Falls, NJ (US)

( * ) Notice: Subject to any disclaimer, the term of this patent is extended or adjusted under 35 U.S.C. 154(b) by 570 days.

(21) Appl. No.: 13/798,792

(22) Filed: Mar. 13, 2013

(51) Int. Cl.
*A61H 1/02* (2006.01)

(52) U.S. Cl.
CPC ..... *A61H 1/0292* (2013.01)

(58) Field of Classification Search
CPC . A61H 1/0218; A61H 1/0222; A61H 1/0229; A61H 1/0292; A61H 1/0296; A63B 23/04; A63B 23/0405; A63B 23/0494; A63B 23/03508
USPC ..... 606/237, 240, 241
See application file for complete search history.

(56) References Cited

U.S. PATENT DOCUMENTS

| | | | | |
|---|---|---|---|---|
| 439,255 | A * | 10/1890 | Ruebsam | A61F 5/04 602/35 |
| 4,884,803 | A * | 12/1989 | Miller | A61H 1/0218 482/140 |
| 5,261,865 | A | 11/1993 | Trainor | |
| 6,203,473 | B1 | 3/2001 | Atwood | |
| 6,767,314 | B2 * | 7/2004 | Thompson | A63B 21/068 482/135 |
| 6,835,170 | B2 | 12/2004 | Ogle | |
| 6,986,181 | B2 * | 1/2006 | Murphy | A61H 1/0292 5/624 |
| 7,476,182 | B2 | 1/2009 | DeNisco | |
| D589,623 | S | 3/2009 | Olliges | |
| 7,604,583 | B2 | 10/2009 | DeNisco | |
| 7,762,936 | B2 | 7/2010 | Conley et al. | |
| 7,841,973 | B2 | 11/2010 | Trancart et al. | |
| 7,946,971 | B2 | 5/2011 | Conley et al. | |
| 2005/0227837 | A1 | 10/2005 | Broadbent | |
| 2006/0142683 | A1 | 6/2006 | Johnson et al. | |
| 2011/0105965 | A1 * | 5/2011 | Gardner | A63B 21/0611 601/27 |

* cited by examiner

*Primary Examiner* — Justine Yu
*Assistant Examiner* — Kathrynn Lyddane
(74) *Attorney, Agent, or Firm* — Norman E. Lehrer

(57) ABSTRACT

A spinal decompression apparatus includes a horizontal base having left and right sides, a front end and a rear end and having an upper surface upon which a patient can lie on his back. Left and right horizontal guide rails are located adjacent the left and right sides of the base and left and right uprights are adjacent the rear end thereof. Left and right inclined rails have their upper ends movably attached to the uprights and their lower ends movable horizontally along the guide rails. A knee bar extends horizontally across the apparatus between the inclined rails and is positioned so as to permit a person lying on the base to place the back of his knees around the knee bar. A motor connected to the knee bar and operated by the patient moves the knee bar up or down the inclined rails. The angle of inclination of the inclined rails is manually adjustable.

15 Claims, 3 Drawing Sheets

SPINAL DECOMPRESSION APPARATUS

BACKGROUND OF THE INVENTION

The present invention is directed toward spinal decompression therapy. More specifically, the present invention relates to an improved apparatus for implementing spinal decompression therapy.

Spinal decompression therapy is utilized to treat various spinal ailments including, for example, herniated discs, degenerative disc disease, sciatica, posterior facet syndrome, and post surgical pain. Decompression therapy is a derivative of traction-based therapy, which includes placing a patient's spine in a state of tension. The tension is created by an outside force such as a therapist manually applying tension to a patient's spine. Alternatively, equipment or apparatuses can be used to apply the tension. In traction-based therapy, the spine is held in a continuous state of tension.

Decompression therapy differs from standard traction-based therapy in that the traction applied to the spine in decompression therapy is typically alternated between lower and higher levels of tension for predetermined periods of time. In either therapy, spinal tension is maintained for periods typically extending 30 minutes or longer.

As the spine is placed into a state of tension, the spinal vertebras are separated allowing the intervertebral discs to realign into their proper positions. This action also allows herniated discs time to heal in a non-loaded state. In addition, nutrient-rich spinal fluid is drawn to the sites of tension due to the pressure drop created by the tensile forces.

Various forms of equipment and apparatuses have been proposed in the past to perform decompression therapy. Some equipment is relatively complicated and difficult to operate or require trained personnel to operate the same. Other, simpler pieces of equipment are designed for the average patient to use on his or her own. None, however, has been shown to be completely satisfactory.

For example, prior U.S. Design Pat. No. D589,623 to Olliges is entitled Spinal Decompression Apparatus. However, there is no description therein as to how the apparatus works or how a patient would use the same. U.S. Pat. No. 6,835,170 that issued to Ogle is entitled Low Back Stretching Sleeper and seems to describe an exercise apparatus for stretching the back and increasing low back strength. There are, however, no moving parts. The patient must use his or her own arm strength to lift his or her upper body in order to use the apparatus.

Japanese Published Application No. JP200012633 seems to describe an apparatus that might have some benefit in decompressing a person's spine. From the drawings, it appears that the user lies on his back and places his feet up against a movable foot rest. The patient then pulls the foot rest toward his body to decompress his spine. Again, however, this is a manual operation requiring significant arm and upper body strength which limits the amount of time that a person is able to use the apparatus and hold themselves in the appropriate position in order to properly decompress the spine.

There is, therefore, a need for a spinal decompression apparatus that can be used by a patient and that does not require upper body strength or the use of the patient's arms and that can maintain the patient's body in the proper position for extended periods of time in order to effectively decompress the spine.

SUMMARY OF THE INVENTION

The present invention is designed to overcome the deficiencies of the prior art discussed above. It is an object of the present invention to provide an apparatus that effectively decompresses a patient's spine.

It is another object of the present invention to provide an apparatus that effectively decompresses a patient's spine and that can be operated by the patient.

It is a still further object of the present invention to provide an apparatus that effectively decompresses a patient's spine and that is motor driven so that the patient need not use his or her arms or upper body to effect the decompression.

In accordance with the illustrative embodiments demonstrating features and advantages of the present invention, there is provided a spinal decompression apparatus that includes a horizontal base having left and right sides, a front end and a rear end and having an upper surface upon which a patient can lie on his back. Left and right horizontal guide rails are located adjacent the left and right sides of the base and left and right uprights are adjacent the rear end thereof. Left and right inclined rails have their upper ends movably attached to the uprights and their lower ends movable horizontally along the guide rails. A knee bar extends horizontally across the apparatus between the inclined rails and is positioned so as to permit a person lying on the base to place the back of his knees around the knee bar. A motor connected to the knee bar and operated by the patient moves the knee bar up or down the inclined rails. The angle of inclination of the inclined rails is manually adjustable.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
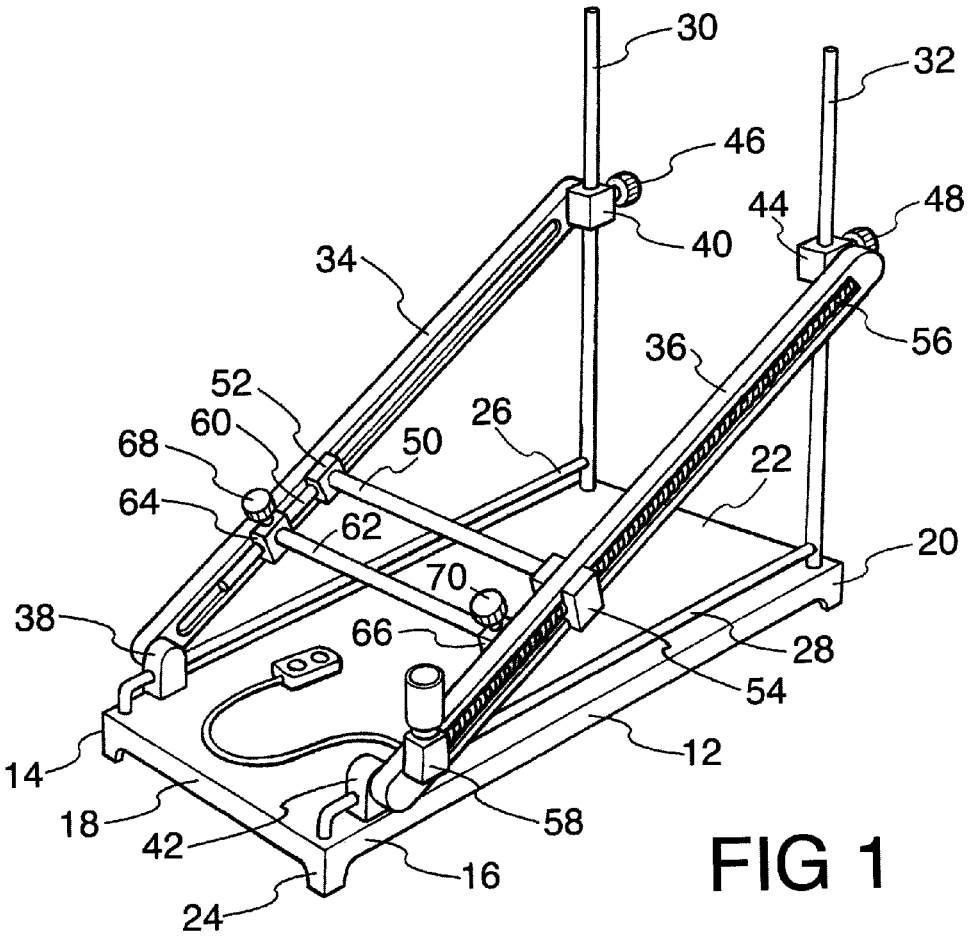
FIG. 1 is a front perspective view of the spinal decompression apparatus of the present invention.
Figure 2:
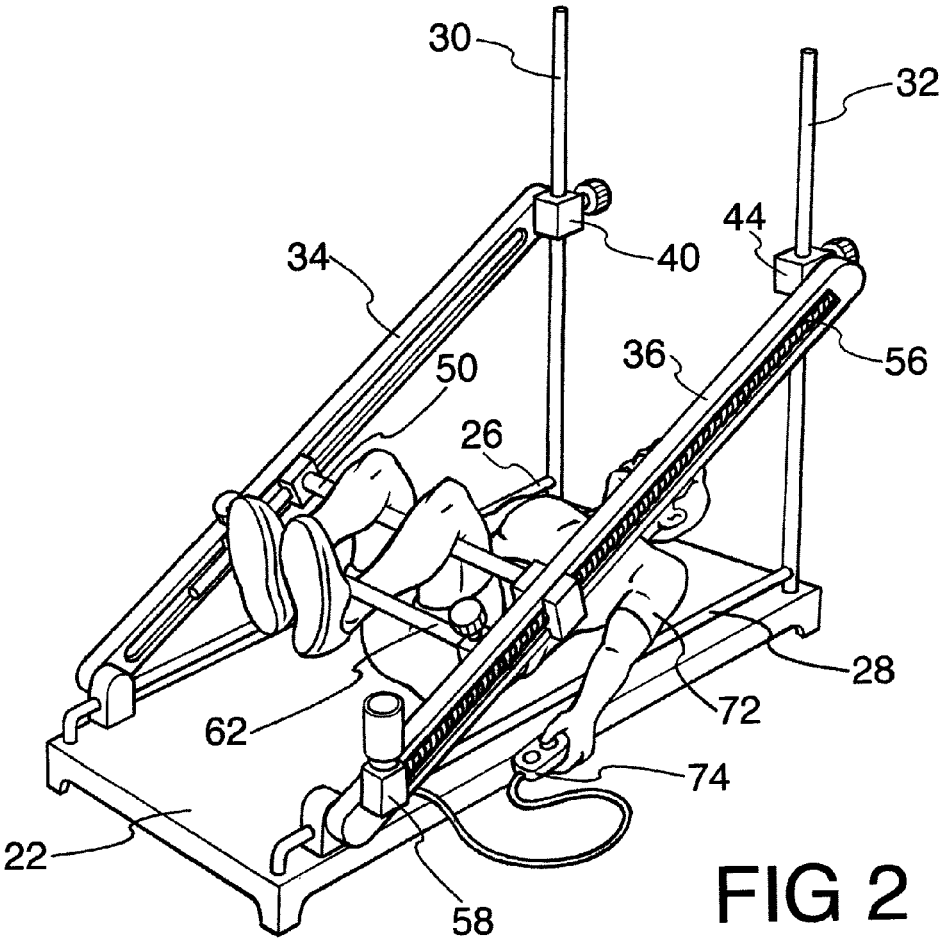
FIG. 2 is a front perspective view similar to FIG. 1 but with a patient lying on the apparatus and about to utilize the same.
Figure 3:
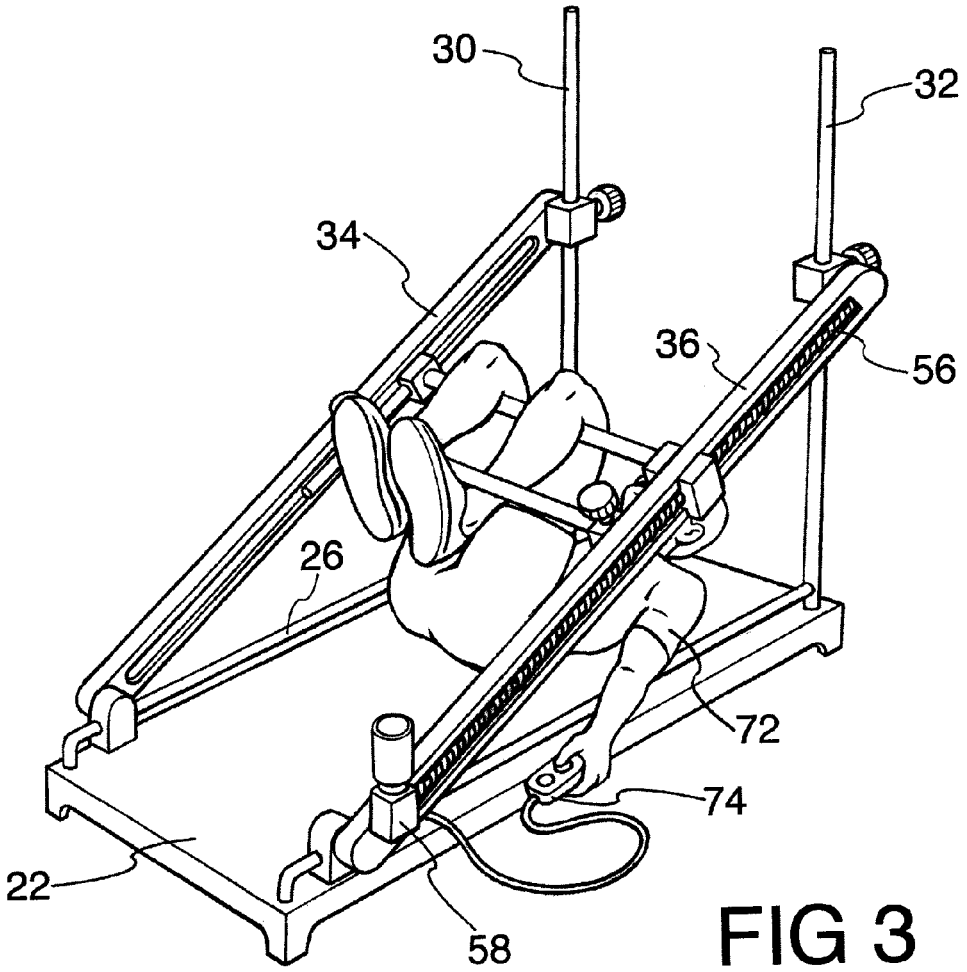
FIG. 3 is a front perspective view similar to FIG. 2 but illustrating how the apparatus decompresses the patient's spine.

Referring now to the drawings in detail wherein like reference numerals have been used throughout the various figures to designate like elements, there is shown in FIGS. 1-3 a spinal decompression apparatus constructed in accordance with the principles of the present invention and designated generally as 10.

The spinal decompression apparatus 10 is comprised of several component parts including a substantially rectangularly shaped base 12 having left and right sides 14 and 16, a front end 18 and a rear end 20. The base also includes an upper surface 22 upon which a patient can lie on his or her back.

Although the base 12 is shown with relatively short feet 24, this is by way of example only. The feet 24 could be substantially longer so as to raise the upper surface 22 above the ground. Furthermore, adjustable legs or feet could be utilized so that the height of the base 22 can be adjusted. As will become readily apparent, in some situations, it may be desirable to have the upper surface 22 be at substantially chair level so as to make it easier for a person to sit thereon.

Left and right horizontal guide rails 26 and 28 are located adjacent the left and right sides 14 and 16, respectively, of the base 12. The guide rails 26 and 28 are preferably circular in cross section and extend substantially the length of the base 12. Extending substantially vertically upwardly from the rear end 20 of the base 12 are left and right uprights 30 and 32. Again, in the preferred embodiment of the invention, the uprights 30 and 32 are preferably circular in cross section.

Also provided are left and right incline rails 34 and 36. The lower end of the inclined rail 34 includes a bearing block 38 having an opening through the center thereof which allows the same to move horizontally along the length of the guide rail 26. The upper end of the inclined rail 34 also includes a bearing block 40 that includes an opening through the center thereof allowing the same to move up and down the upright 30. The bearing blocks 38 and 40 are pivotally attached to the guide rail 34 so as to allow them to rotate as the inclined rail is moved up or down.

Similarly, the right inclined rail 36 includes a bearing block 42 that rides on the guide rail 38. It also includes a bearing block 44 that rides on the upright 32. The inclination of the inclined rails 32 and 34 can be adjusted by loosening the knobs 46 and 48 that are threaded into the bearing blocks 40 and 44 to allow these blocks to move up or down. The lower bearing blocks 38 and 42 will simply slide along the rails 26 and 28. When the inclined rails 34 and 36 are in their desired position, the knobs 46 and 48 are tightened.

Extending horizontally between the inclined rails 34 and 36 and across the apparatus is a knee bar 50. The knee bar 50 is supported at each end by bearings 52 and 54. Either or both of the inclined rails 34 and 36 can be provided with an elongated screw such as shown at 56. The bearing block 54 includes a complementary internal thread through which the screw 56 passes. When the motor 58 is driven, the screw 56 rotates either clockwise or counterclockwise thereby moving the bearing block 54 up or down the inclined rail 56 which carries the knee bar 50 with it. Again, a similar arrangement can be provided on the inclined rail 34 or it is possible to merely have the bearing block 52 ride up and down the rail passively as a result of the force of the knee bar 50 being moved by the motor 58.

Extending downwardly from the knee bar 50 at the ends thereof are guide bars such as shown at 60. While only one such guide bar 60 is shown on the left side, it should be readily apparent that a substantially identical guide bar appears on the right side. While the guide bar 60 is shown at an angle which corresponds to the inclination of the inclined rails 34 and 36, it is also possible to allow the guide bars to extend more vertically downwardly. It is also within the scope of the invention to have the angle be adjustable so that the guide bar 60 can extend vertically downwardly but be pivotable up to the position as shown in the figures.

A second ankle bar 62 having bearing blocks 64 and 66 at each end thereof extends horizontally across the apparatus with the bearing blocks being movably mounted on the guide bar 60. The distance between the knee bar 50 and the ankle bar 62 can, therefore, be adjusted by loosening the knobs 68 and 70 and moving the bearing blocks 64 and 66. Thus, while the distance between the knee bar 50 and the ankle bar 62 can be adjusted, both bars move in unison with each other when driven by the motor 58.

The apparatus described above is utilized in the following manner. As shown in FIG. 2, a patient 72 lies on his or her back on the upper surface 22 of the base 12. He then places his knees over the knee bar 50 so that the bar is behind the knees. He then places his ankles under the ankle bar 62 as shown in FIG. 2. Obviously, the distance between the ankle bar 62 and the knee bar 50 had previously been adjusted by the patient to accommodate the length of his lower legs. Once in position, the patient can move the knee bar (along with the ankle bar 62) up or down along the inclined rails 34 and 36 by utilizing the up/down buttons on the controller 74 that activates the motor 58. As shown in FIG. 3, as the knee bar 50 moves up the inclined rails 34 and 36, the patient's lower back is raised off of the surface 22 thereby decompressing his spine.

The angle of inclination of the inclined rails 34 and 36 can be adjusted as described above. This is done to either accommodate a patient of larger or smaller size or to allow more or less decompression of the spine. In operation, the patient can raise the knee bar upwardly and hold it in that position for any desired period of time and can lower it when desired. Alternatively, the patient can repeatedly move the bar up and down.

The present invention may be embodied in other specific forms without departing from the spirit or essential attributes thereof. For example, the dimensions of the apparatus can be changed as can the positions of the various parts. By way of further example, while the guide rails are shown parallel to and close to the base, they could be raised off of the base and could be inclined relative thereto. Other modifications will be apparent to those skilled in the art, and accordingly, reference should be made to the appended claims rather than to the foregoing specification as indicating the scope of the invention.

I claim:

1. A spinal decompression apparatus comprising:

a substantially horizontal base having left and right sides, a front end and a rear end and having an upper surface upon which a patient can lie on his back;

left and right inclined rails having upper ends and lower ends, said inclined rails being positioned adjacent the sides of said base;

a knee bar extending horizontally between said inclined rails extending horizontally between said inclined rails, a second bar extending between said inclined rails and being parallel to said knee bar but spaced therefrom so as to permit a person lying on said base to place the back of his knees around said knee bar and place his ankles below said second bar, wherein the knee bar and the second bar are each elongated, and motor means for moving said knee bar along with said second bar up or down said inclined rails.

2. The spinal decompression apparatus as claimed in claim 1 further including means for adjusting an angle of inclination of said inclined rails.

3. The spinal decompression apparatus as claimed in claim 2 wherein said adjusting means includes left and right horizontal guide rails located adjacent said left and right sides of said base and left and right uprights adjacent said rear end of said base and wherein each of said inclined rails includes at the lower end thereof a lower block movable horizontally along said guide rails and an upper block at its upper end movable vertically on said uprights.

4. The spinal decompression apparatus as claimed in claim 3 further including means for locking said inclined rails in one of a plurality of fixed inclined positions.

5. The spinal decompression apparatus as claimed in claim 1 further including control means accessible to the patient for controlling the operation of said motor means.

6. The spinal decompression apparatus as claimed in claim 1 wherein said knee bar includes a bearing at each end thereof and wherein said inclined rails pass through said bearings.

7. The spinal decompression apparatus as claimed in claim 6 wherein one of said inclined rails is in the form of an elongated screw.

8. The spinal decompression apparatus as claimed in claim 1 including means for adjusting a distance along the inclined rails between said second bar and said knee bar.

9. A spinal decompression apparatus comprising:

a substantially horizontal base having left and right sides, a front end and a rear end and having an upper surface upon which a patient can lie on his back;

left and right horizontal guide rails located adjacent said left and right sides of said base;

left and right uprights adjacent said rear end of said base;

left and right inclined rails having upper ends and lower ends, each of said inclined rails including a lower block at the lower end thereof movable horizontally along said guide rails and including an upper block at the upper end thereof movable vertically on said uprights;

a knee bar extending horizontally between said inclined rails extending horizontally between said inclined rails, a second bar extending between said inclined rails and being parallel to said knee bar but spaced therefrom so as to permit a person lying on said base to place the back of his knees around said knee bar and place his ankles below said second bar, wherein the knee bar and the second bar are each elongated, and motor means for moving said knee bar along with said second bar up or down said inclined rails.

10. The spinal decompression apparatus as claimed in claim 9 further including means for adjusting an angle of inclination of said inclined rails.

11. The spinal decompression apparatus as claimed in claim 10 further including means for locking said inclined rails in one of a plurality of fixed inclined positions.

12. The spinal decompression apparatus as claimed in claim 9 further including control means accessible to the patient for controlling the operation of said motor means.

13. The spinal decompression apparatus as claimed in claim 9 wherein said knee bar includes a bearing at each end thereof and wherein said inclined rails pass through said bearings.

14. The spinal decompression apparatus as claimed in claim 13 wherein one of said inclined rails is in the form of an elongated screw.

15. The spinal decompression apparatus as claimed in claim 9 including means for adjusting a distance along the inclined rails between said second bar and said knee bar.

* * * * *